US006365819B2

(12) United States Patent
Yamada

(10) Patent No.: US 6,365,819 B2
(45) Date of Patent: Apr. 2, 2002

(54) ELECTRONIC MUSICAL INSTRUMENT PERFORMANCE POSITION RETRIEVAL SYSTEM

(75) Inventor: Nobuhiro Yamada, Hamamatsu (JP)

(73) Assignee: Roland Corporation, Osaka (JP)

( * ) Notice: Subject to any disclaimer, the term of this patent is extended or adjusted under 35 U.S.C. 154(b) by 0 days.

(21) Appl. No.: 09/745,843

(22) Filed: Dec. 21, 2000

(30) Foreign Application Priority Data

Dec. 24, 1999 (JP) ..... 11-366142

(51) Int. Cl.[7] ..... G04B 13/00; G10H 7/00

(52) U.S. Cl. ..... 84/609; 84/600; 84/610; 84/634; 84/649; 84/650

(58) Field of Search ..... 84/600–604, 609–612, 84/634–636, 649–652, 666–668

(56) References Cited

U.S. PATENT DOCUMENTS 5,913,259 A * 6/1999 Grubb et al. ..... 84/610
6,245,984 B1 * 6/2001 Aoki et al. ..... 84/611

* cited by examiner

*Primary Examiner*—Marlon T. Fletcher
(74) *Attorney, Agent, or Firm*—Foley & Lardner

(57) ABSTRACT

The present invention relates to a performance position retrieval system that is installed in such things as electronic musical instruments. Its object is to enable rapid and more accurate searching for a position in a musical composition that the performer etc. is currently performing. It is provided with an automatic performance means in which the performance data for the musical composition are stored and an automatic performance is carried out in accordance with that performance data and an input means in which the performer inputs the performance data for the performance and a retrieval table with which a prescribed computation is carried out for a sequence of a specified amount of performance data from the above mentioned performance data for the musical composition, demarcation is done in accordance with the computation results and the position information is stored and a retrieval means in which the above mentioned prescribed computation is carried out for a sequence of the performance data that have been input in the above mentioned input means and the performance position is retrieved based on the above mentioned retrieval table in accordance with the results of the computation.

31 Claims, 7 Drawing Sheets

| Add | Event | Note (No.) | Duration | Vel |
|---|---|---|---|---|
| 0 | 0 | C (60) | 50 | $V_1$ |
| 1 | 50 | D (62) | 49 | $V_2$ |
| 2 | 49 | E (64) | 51 | $V_3$ |
| 3 | 48 | G (67) | 47 | • |
| 4 | 51 | $C_1$ (72) | 98 | • |
| 5 | 2 | A (69) | 87 | • |
| 6 | 1 | F (65) | 88 | • |
| 7 | 98 | B (71) | 101 | • |
| | | | | |

ELECTRONIC MUSICAL INSTRUMENT PERFORMANCE POSITION RETRIEVAL SYSTEM

PRIORITY

The present invention relates to Japanese application No. 11 366142 filed Dec. 24, 1999, which is incorporated by reference herein and from which priority is claimed.

FIELD OF THE INVENTION

The present invention is one that relates to a performance position retrieval system that is installed in, for example, electronic musical instruments.

BACKGROUND OF THE INVENTION

Automatic performance systems that, in the case of the performance of a musical composition with an electronic musical instrument, automatically track the performance by the performer with a musical accompaniment are known. With regard to this tracking, the automatic performance tracking system detects the position of the composition that is performed and an automatic performance is carried out with, for example, a musical accompaniment that coincides with the performance and which matches the tempo of the performance. Accordingly, it is necessary for the automatic performance tracking system to accurately search at that instance, from the performance data that is performed, to determine the position in the composition of the performance.

According to one known method for an automatic performance tracking system to retrieve the position of a composition that is being performed, the automatic performance tracking system compares in detail the line of musical tones (notes; hereafter, referred to as the "note line") for the most recent multiple number of note lines that have been performed with the note lines on the music score as well as the pitch and length of each of these notes and the point where the performed note line and the note line on the music score are in agreement. That point is considered the performance position.

With the methods of the past, since the automatic performance tracking system had to compare and validate the performed note line and the note line on the music score from the beginning of the composition for each performance (for example, for each key pressing), the retrieval speed was slow. In addition, there have been weaknesses in the accuracy of judgment, in a case where there are a multiple number of locations in the composition where there is agreement, of which of the locations that agree should be determined to be the performance position.

The present invention takes the relevant problems into consideration and has as its object making it possible to search rapidly and more accurately for a position in a musical composition that the performer, etc., is currently performing.

SUMMARY OF THE DISCLOSURE

In order to solve the problems discussed above, the electronic musical instrument performance position retrieval system that is related to the present invention is, in its basic form, provided with an automatic performance means in which the performance data for the musical composition are stored and an automatic performance is carried out in accordance with that performance data, an input means in which the performer inputs the performance data for the performance and a retrieval table with which a prescribed computation is carried out for a sequence of a specified amount of performance data from the above mentioned performance data for the musical composition. Demarcation is done in accordance with the computation results and the position information is stored. A retrieval means, in which the above mentioned prescribed computation is carried out for a sequence of the performance data that have been input in the above mentioned input means, retrieves the performance position based on the above mentioned retrieval table in accordance with the results of the computation.

In addition, this performance position retrieval system can be configured so that it is provided with a means in which, for the position information that has been retrieved based on the above mentioned retrieval table, verification is done with prescribed retrieval rules and the performance position is determined.

With this performance position retrieval system, the retrieval table is formed by taking a sequence of the performance data (performance data that are continuous or that skip an amount etc.), carrying out a prescribed computation such as a hash function with these, making the demarcation of the performance data line in accordance with the results of the computation and storing their position information in the musical composition. This position information can be made so that it is, for example, the position information in a musical composition for the performance data that have been input most recently in a sequential performance data line.

When the performer successively inputs the musical tone performance data with an input means such as a keyboard, a prescribed computation is successively carried out by the retrieval means on the sequence of performance data that have been successively input. The retrieval table is then searched based on the results of the computation. Then, one or a multiple number of items of position information are fetched in accordance with the computation results and the performance position of the performer is retrieved.

With this performance position retrieval, it is possible for the performer to infer the performance position in the musical composition that is being performed with the position information that have been selected in accordance with prescribed retrieval rules for the one or multiple number of items of position information that have been, for example, fetched from the retrieval table.

Here, the above mentioned retrieval rules can be formulated, such as, for example, the following.

(1) If the position information that has been retrieved is within $\pm\alpha$ ($\alpha$ is, for example, one bar etc.) of the current position in the automatic performance, that position information is ignored.

(2) If the items of position information that have been retrieved are prior temporally to the current position in the automatic performance, the position information that is closest to the current position is selected.

However, if the most proximate items of position information are both within $\beta$ ($\beta$ is, for example, two bars), the position information that is further in front temporally (nearer the beginning of the composition) is selected.

(3) If the items of position information that have been retrieved are only temporally after the current position in the automatic performance, the position information that is closest to the current position is selected.

In addition, if this performance position retrieval system is provided with a transfer means in which the performance position of the automatic performance is transferred to the performance position that has been assumed by the above mentioned assumption means, it is possible for it to automatically track the performance position of the performer.

DETAILED DESCRIPTION OF PREFERRED EMBODIMENTS

Figure 2:
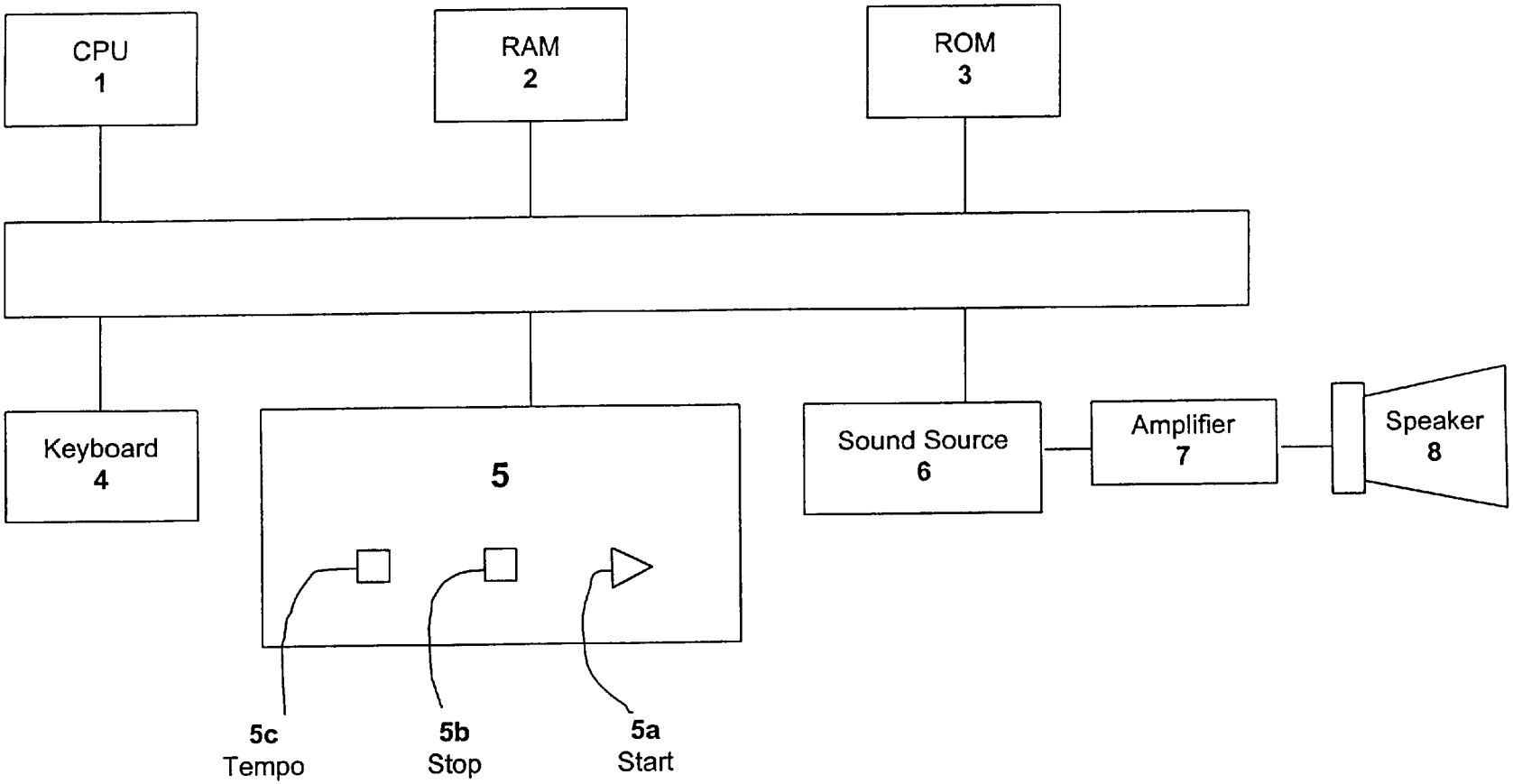
FIG. 2 is a diagram that shows the overall structure of a performance position retrieval system for an electronic musical instrument that is one preferred embodiment of the present invention.

FIG. 2 shows an electronic musical instrument that has had a performance position retrieval system installed according to one preferred embodiment of the present invention. This electronic musical instrument has an automatic performance function installed and, with this automatic performance function, the positions on the musical score of the musical tones (hereafter, referred to as the "notes") that have been performed and input from the keyboard are retrieved. The accompaniment of the musical composition is matched with the performance position and automatically performed.

In FIG. 2, a central processing unit (CPU) 1 manages the control of the entire system. A random access memory (RAM) 2 is used as the memory working region for temporarily storing such things as the automatic performance data, the musical composition data table, and the hash table drawn up by CPU 1 which will be discussed below. A read only memory (ROM) 3 stores, for example, the program used to control the CPU 1 and various kinds of tables. The keyboard 4 allows the performer to carry out a manual performance. An operating panel 5 includes, for example, the start button 5*a* to begin the automatic performance, the stop button 5*b* to stop the automatic performance and the tempo operator 5*c* to set the tempo speed of the automatic performance. A sound source 6 generates the musical tone signals that are endowed with timber and effects based on the performance data that have been passed by the CPU 1. An amplifier 7 amplifies the musical tone signals from the sound source 6, and the speaker 8 converts the amplified musical tone signals into sound.

In this preferred embodiment system, the musical composition data table and the hash table, which will be discussed below, are drawn up for the musical composition that is automatically performed by the automatic performance function and stored in the RAM 2.

Incidentally, the Tick is used as the unit for the items that relate to time which are shown in these tables. Here, one Tick is the time unit in which a quarter note has been made equal to 100 ticks (in other words, one tick is the clock interval in the case where 100 clocks are generated for one quarter note). Since the value of the tempo expresses the number of quarter notes for one minute, the time length of one quarter note changes in accordance with the value of the tempo. Therefore, the time length of one Tick depends on the value of the tempo.

Figure 3:
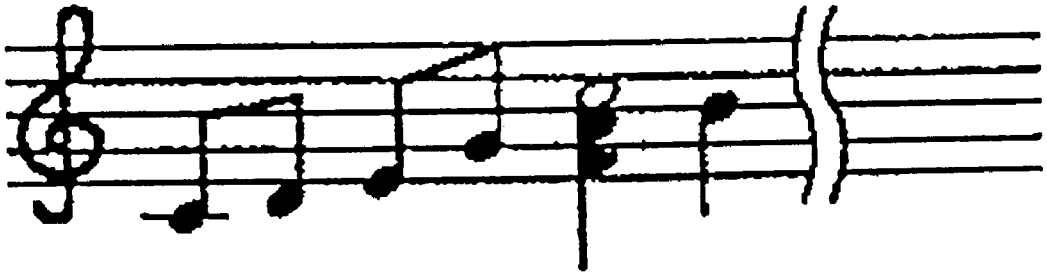
FIG. 3 is a diagram that shows the music score of a musical composition (the beginning portion of the musical composition) that is used as the search object by one preferred embodiment system.
Figures 4, 5:
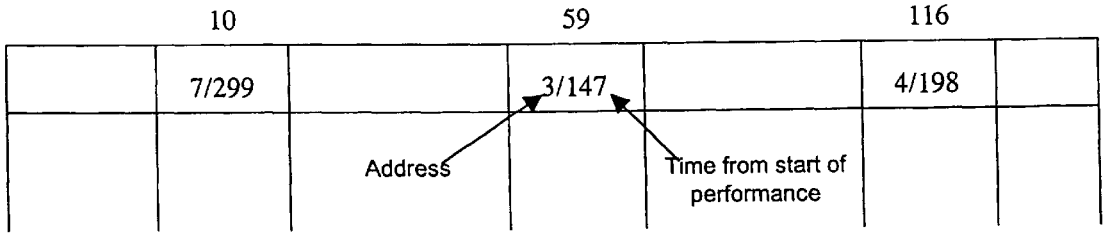
FIG. 4 is a diagram that shows the musical composition data table of the music score portion of FIG. 3.
FIG. 5 is a diagram that shows an example of a hash table that has been derived for the musical composition of the preferred embodiment.

At this time, for example, the musical composition data table for the musical composition that shows a portion of the musical score in FIG. 3 (the beginning portion of the composition) is drawn up. In FIG. 4, the musical composition data table that corresponds to each of the notes (each of the musical tones) in the music score is shown. In FIG. 4, the pointer Add indicates the address of the memory in which the note data for the appropriate notes are stored, the event interval Event indicates the time interval from the note-ON of the note immediately before to the note-ON for the appropriate note (the time unit is Tick), the note number Note No. indicates the pitch of the appropriate note (indicates the name of the note and the note number), the Duration indicates the time from the note-ON of the appropriate note to the auto-OFF (the continuous key pressing time; the time unit is Tick) and the velocity Vel indicates the strength of the keystroke for the appropriate note.

Here, in the musical composition data table of FIG. 4, for example, for the notes of the fifth chord that is shown in FIG. 3, the event interval Event is expressed as three sounds that are close together (the pointers Add are the 4, 5 and 6 for $C_1$, A and F). With regard to the concerned chord, only the highest pitch (in this example, it is $C_1$) from among the three sounds of the sound structure is used in drawing up the hash table that will be discussed later.

In FIG. 5, the hash table that has been drawn up for the note line in FIG. 3 based on the musical tone data table of FIG. 4 is shown. With this hash table, the respective hash keys (hash values) for each of the notes on the music score are derived by a method that will be discussed later. The information for each of the notes that correspond to the values for each of the hash keys that have been derived is registered as an item, and this item comprises the pointer Add of the appropriate note and the time that has passed (the time unit is Tick) from the beginning of the composition.

The hash key for the note that is currently being observed (referred to as the "appropriate note") is derived by the following hash computation for the four notes that have most recently been performed and input that include the appropriate note (the appropriate note and the three notes that have been performed immediately before).

That is to say, to derive the hash key of the appropriate note Note(i), in the case where the note numbers for the four notes that have the note-ON close together and include the appropriate note Note(i), Note(i−3), Note(i−2), Note(i−1) and Note(i), are respectively made N(i−3), N(i−2), N(i−3) and N(i), and the coefficients are made $\alpha 1$, $\alpha 2$, $\alpha 3$ and $\alpha 4$, the following hash computation is carried out:

$$\Sigma[N(i-j)\times\alpha(1+j)]/M \text{ (Actually, } \Sigma \text{ is added from } j=0 \text{ to } 3)=(N(i)\times\alpha 1+N(i-1)\times\alpha 2+N(i-2)\times\alpha 3+N(i-3)\times\alpha 4)/M \quad \text{Eqn.\#1}$$

and the remainder as the result of the division of $(N(i)\times\alpha 1+N(i-1)\times\alpha 2+N(i-2)\times\alpha 3+N(i-3)\times\alpha 4)$ by M is made the hash key (the hash value). Incidentally, with regard to a chord, it is done with the pitch of the highest sound of its structure.

Here, due to the fact that in this preferred embodiment, M is set equal to 128, the hash values are the 128 values of 0 to 127; and it is possible to demarcate at any hash key of 0 to 127 for each note in the music score. A suitable value is selected based on experience for the value of M. In conformance with the hash key that has been derived in this manner, the information for the note Note(i) is stored as an item (comprising the pointer Add and the time that has passed from the start of the performance of the composition). This is carried out for each of the notes of the entire composition, and the hash table is drawn up. In this manner, in the fields for each of the hash keys of the hash table, the items that correspond to each of the notes in order of the earliest in time from the beginning of the musical composition are respectively lined up in order from the first field.

An example of the calculation of 3 hash keys using equation number one is shown below. $\alpha 1$, $\alpha 2$, $\alpha 3$, $\alpha 4$ and M are constants, which appear in equation 1. M is simply being number of columns within the hash table. While M can be a variety of values powers of 2 may be very convenient to use. M may be chosen as a large number for very long compositions and may be chosen as a smaller number for very short compositions. In the present exemplary embodiment, M was chosen to be 128, and the hash table will contain 128 columns, the columns being numbered from 0 to 127. The constants $\alpha 1$, $\alpha 2$, $\alpha 3$ and $\alpha 4$ are generally chosen experimentally. Their values are chosen in order that the hash table entries floor performance will fill in that hash table evenly. Although many other constants will be usable, in the present embodiment the experimentally determine alpha constants are $\alpha 1=5$, $\alpha 2=3$, $\alpha 3=2$ and $\alpha 4=7$.

For example, the first hash key is computed using the notes of C, D, E and G from addresses 0 through 3 as shown in FIG. 4. Note numbers as shown in FIG. 4 are assigned to different notes sequentially and are proportional to pitch. Using equation number 1 and substituting in the values for $\alpha 1$, $\alpha 2$, $\alpha 3$, $\alpha 4$ and M equation 1 becomes:

$(60*5+62*3+64*2+67*7)/128=8$ with a remainder of 59. Therefore, the key index for address number 3 is 59. This data is entered into the table, as seen in FIG. 5. In the table labeled 59, there is an entry representing address number 3 and a number 147 which represents the number of ticks that have elapsed since the beginning of the composition.

The next key is calculated for address number 4 and will utilize the notes D, E, G and C1 representing addresses 1, 2, 3 and 4 respectively. Substituting the values for D, E, G and C1 into equation 1 yields $(62*5+64*3+67*2+72*7)/128=8$ with a remainder of 116, therefore, the key is 116. In FIG. 5 column 116 has an entry of 4/198 representing address 4 which is 198 ticks from the beginning of the composition.

A third key is calculated using the notes E, G, C1 and B. Notes A and F are ignored because notes A and F are part of a chord and only the highest pitch note is used for calculation of hash keys within a chord. Substituting in equation 1 yields: $(64*5+67*3+72*2=71*7)/128=9$ with a remainder of 10, therefore, the key for address number 7 is 10. In FIG. 5 the column with header 10 contains an entry 7/299, which symbolizes that an entry representing address 7 which is 299 ticks from the beginning of the composition.

Those skilled in the arts will recognize that the constants used in $\alpha 1$ for $\alpha 1$, $\alpha 2$, $\alpha 3$, $\alpha 4$ and M are arbitrary and may be tailored to the application or type of music being performed. The preceding example is by way of illustration and other values can be used depending on alternate implementations.

An explanation will be given below concerning the operation of the system of this preferred embodiment.

First, an explanation will be given regarding an outline of the action. Here, the performer selects any optional part of any optional musical composition as the part that will be performed by him or herself, and the remaining parts are performed automatically with the automatic performance function as the accompaniment. With the automatic performance function, the remaining parts are automatically performed so that the position of the note line that is currently being performed by the performer (here this is the four notes the keys for which have most recently been pressed) is always tracked. Because of this, no matter which position in the score is performed with the keyboard by the performer, it is always retrieved. In a case where the position that has been retrieved is shifted from the position in the score that is currently being automatically performed with the automatic performance function, the performance position of the performer and the automatic performance position are made to agree by having the automatic performance jump to the appropriate position that has been retrieved.

Specifically, this is accomplished by the following procedure.

(1) The performer selects the composition that is to be performed. The composition is made up of a multiple number of parts and the performer also selects which parts from among the multiple number of parts he or she will perform.

(2) The CPU 1 draws up a hash table (retrieval table) in advance for the parts of the composition that have been selected using the method that was discussed previously and stores it in the RAM 2.

(3) When the performance is started by the performer, the hash computation discussed previously is carried out for the line of the most recent four notes that contain the notes (note-ON data) that the performer is currently performing and inputting with the keyboard and the hash keys are derived. The hash keys that have been derived are used as an index, the hash table is searched and the items (one or a multiple number) for the notes that correspond to the hash keys are derived.

(4) Based on the items that have been derived, the position on the music score that the performer is currently performing is assumed, that position is determined as the place for the automatic performance to jump to, the automatic performance is made to jump to that position and the automatic performance continues to be carried out tracking the performance position of the performer.

A detailed explanation of the process of the operation discussed above will be given below referring to the flowcharts of FIG. 6, FIG. 7 and FIG. 8.

Figure 6:
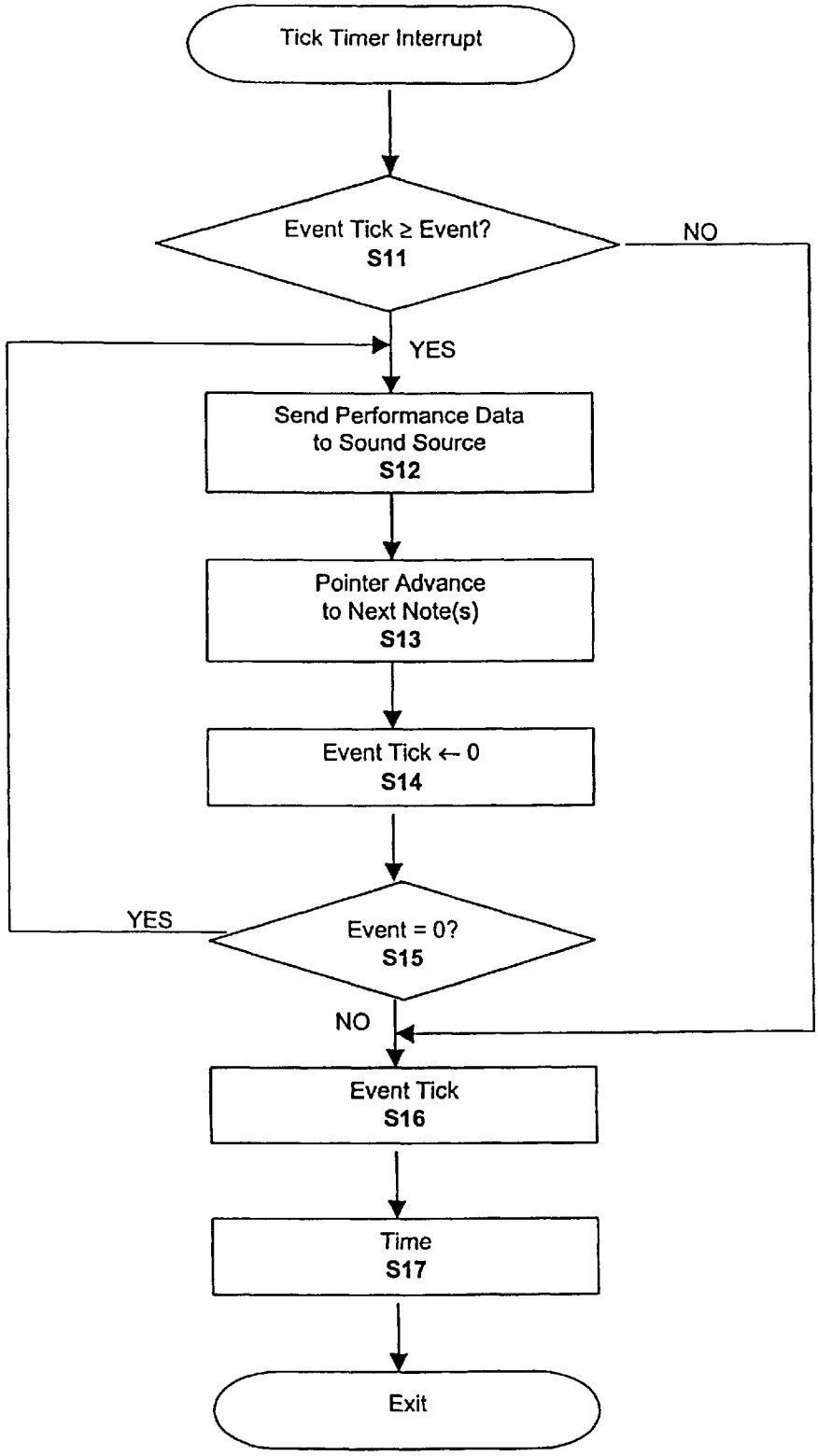
FIG. 6 is a flowchart that shows the processing procedure of the tick timer interrupt process in the preferred embodiment system.

First, FIG. 6 shows the tick timer interrupt processing. The musical composition data are automatically performed with the automatic performance function by means of the tick timer interrupt processing. With the Tick timer processing, an interrupt is run and executed in the CPU 1 for each prescribed time interval of one tick time (Tick). An event timer totals the time elapsed from the note-ON of the most recent note (hereafter, referred to as the "event time Event Tick") for this processing and, with the event timer, the automatic performance function (the sequencer) is counted up at a prescribed time interval (one tick interval). Each time that happens, it is compared with the event interval Event for the note that is indicated by the pointer Add of the sequencer.

In FIG. 6, the tick timer interrupt is run with the passage of each single tick time Tick and the processing routine of FIG. 6 is launched. First, the musical composition data table for the part that is automatically performed (the same as in FIG. 4) is referred to, and the current event time Event Tick is compared with the event interval Event for the note that is indicated by the sequence pointer Add (Step S11). When the two are not in agreement, since after the note-ON is done for the most recent note, this means that that note continues and the note generation timing has not yet reached the next note, the processing for the musical tone generation (Steps S12 through S15) is jumped over, the event time Event Tick and the chord detection time Time are each incremented one tick time Tick (Steps S16 and S17), and it waits for the next tick time interrupt.

On the other hand when, in Step S11, both are in agreement, this means that the tone generation timing has reached the next note in the automatic performance. Therefore, the performance data for the note that is to be generated next which is indicated by the sequence pointer Add in the musical composition data table are retrieved and sent to the sound source 6, and the generation of the appropriate note is begun (Step S12). Following that, the sequencer pointer Add is advanced by 1 (Step S13) and the event time Event Tick is reset to "0" (Step S14). By means of the reset to "0," the measurement of the passage of time for the event time Event Tick on and after the note-ON for the note that has been newly generated is started.

Then, whether or not the event interval Event is "0" is checked (Step S15). If the event interval Event is "0," it means that the musical tones that are generated at the same time are a multiple number and are a chord. In that case, the processing of Step S12 and after is repeated, and the chord is produced by the simultaneous generation of the musical tones. Following this, the event time Event Tick and the chord detection time Time are each incremented one tick time Tick (Step S16 and S17). Incidentally, with regard to the chord detection time Time, this will be discussed in detail later, but it is a timer for the detection of chords in the music score.

Figure 7:
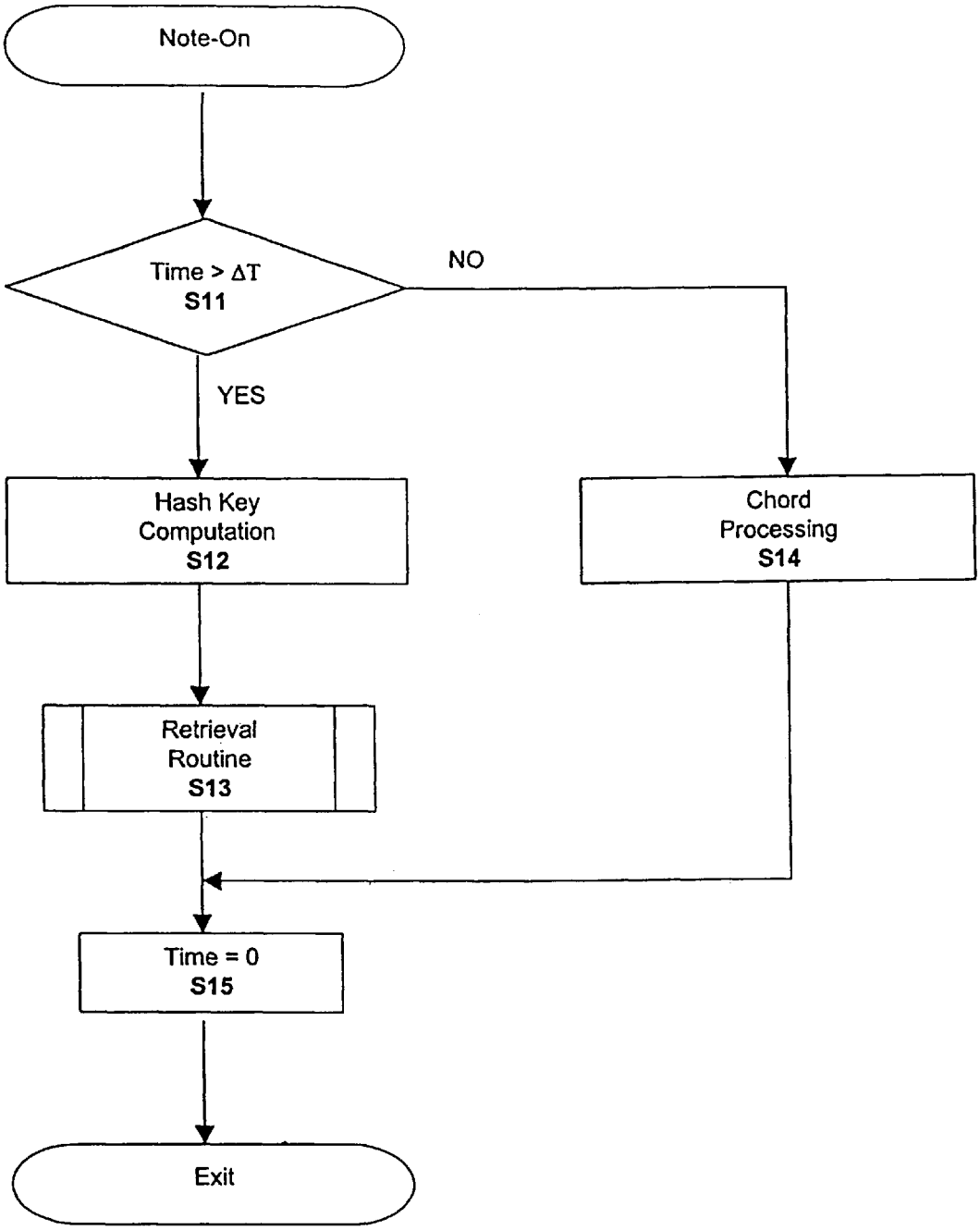
FIG. 7 is a flowchart that shows the processing procedure of the note-ON input process in the preferred embodiment system.

In FIG. 7, the note-ON processing, which is executed every time there is a note-ON due to the key operation by the performer, is shown. When there is a note-ON for a new musical tone, the chord detection time Time is compared with a specified comparison value $\Delta T$, and a determination is made as to whether or not Time>$\Delta T$ (Step S11). The chord detection time Time is a value that is sequentially updated for each single tick time Tick following the note-ON of one note before. Therefore, in the processing of this Step S11, a check is made as to whether or not the time interval from the note-ON of the previous note to the note-ON of the note for which the key is currently being pressed is a specified comparison value $\Delta T$ or less. If the time interval between the previously input note and the currently input note is within the time interval $\Delta T$, it is determined that the two notes have a tone structure relationship between them that forms a chord and, if it exceeds the time interval $\Delta T$, it is determined that the two notes are not structural tones of a chord and are independent notes.

In the case where, in this Step S11, Time$\leqq\Delta T$, in other words, it has been determined that the two tones are structural tones of a chord, the chord processing is carried out (Step S14). In this chord processing, the note numbers of the previous and current note-ON notes are compared as the musical tone of the previous note-ON and the musical tone of the current note-ON that are both structural tones that form a chord, and the higher note number is stored as the note number of the appropriate chord. Therefore, by carrying out this processing sequentially for all of the structural tones of the chords, the highest pitches in the structural tones of the chords are stored as the pitches of the appropriate chords.

In the case where, in Step S11, Time>$\Delta T$, in other words, the two tones are not structural tones of a chord, the hash computation is carried out for the most recent four notes (the current note-ON note and the closest three note-ON notes) and the hash key is derived (Step S12). Then, the retrieval processing routine that will be discussed later is carried out (Step S13). In this retrieval processing routine, what position on the music score the above mentioned four most recent notes exist is retrieved and, in the case where that position is not in agreement with the position in the performance with the automatic performance function, processing is carried out to make the performance position of the automatic performance jump to the performance position that has been performed by the performer.

After the retrieval processing (Step S13) or the chord processing (Step S14) are carried out, the chord detection time Time is reset to "0" (Step S15) and the note-ON processing is terminated.

Figure 8:
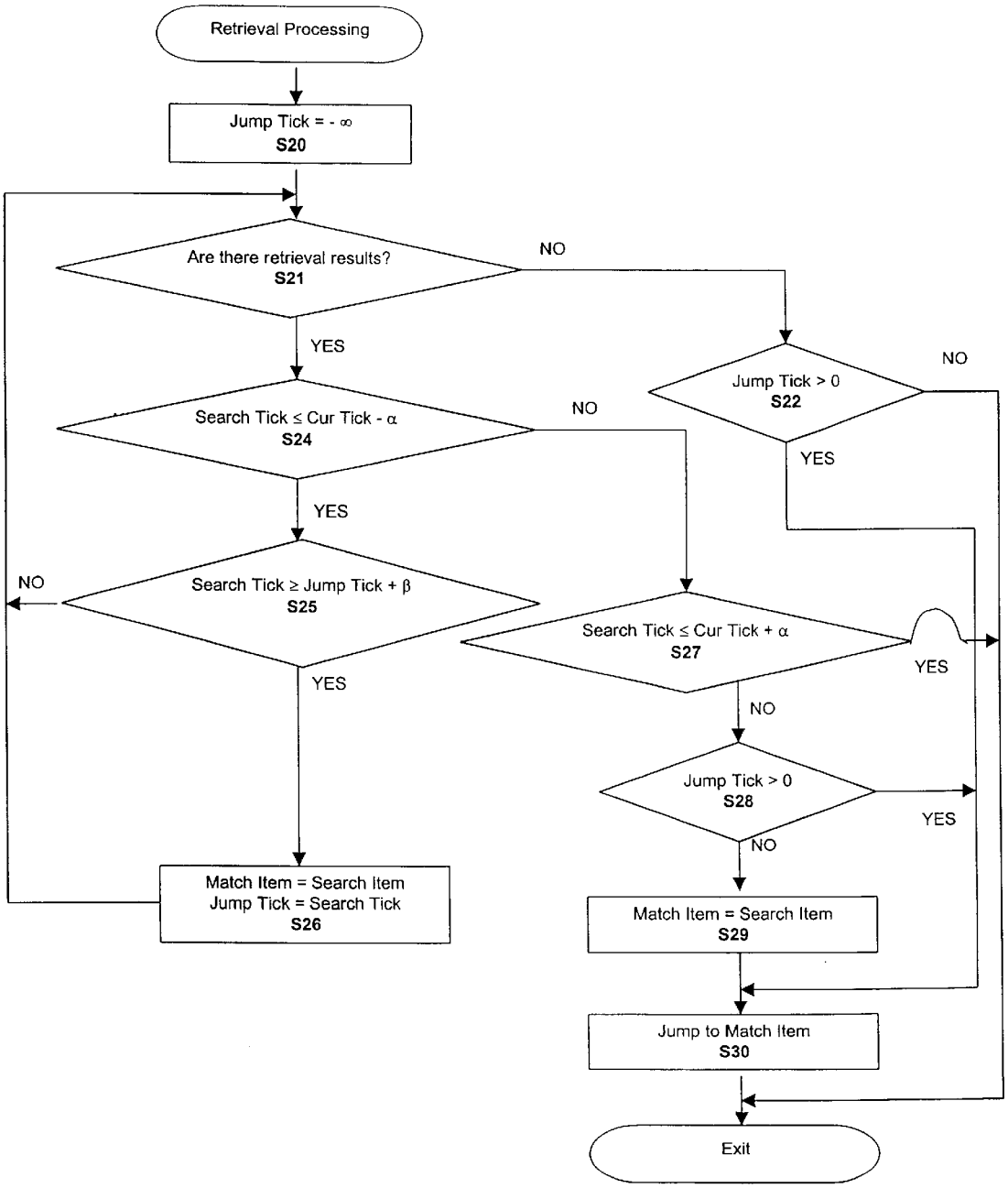
FIG. 8 is a flowchart that shows the processing procedure of the retrieval processing routine in the note-ON input process of the preferred embodiment system.

In FIG. 8, the detailed procedure of the above mentioned retrieval processing routine is shown. In the retrieval processing routine, the position on the music score of the note line that has been performed by the performer is assumed by the searching of the hash table with the hash key that has been derived by the calculations related to that note line, and processing is carried out to make the automatic performance position jump to the position on the music score that has been assumed.

At the time that the searching of the retrieval table is done with the above mentioned keys that have been derived, one or a multiple number of units are derived as the items that correspond to the appropriate hash keys and, in this preferred embodiment, any one of the items is assumed to be the position that is being performed by the performer based on the musical character of the action taken by the performer which will be explained below.

Figure 1:
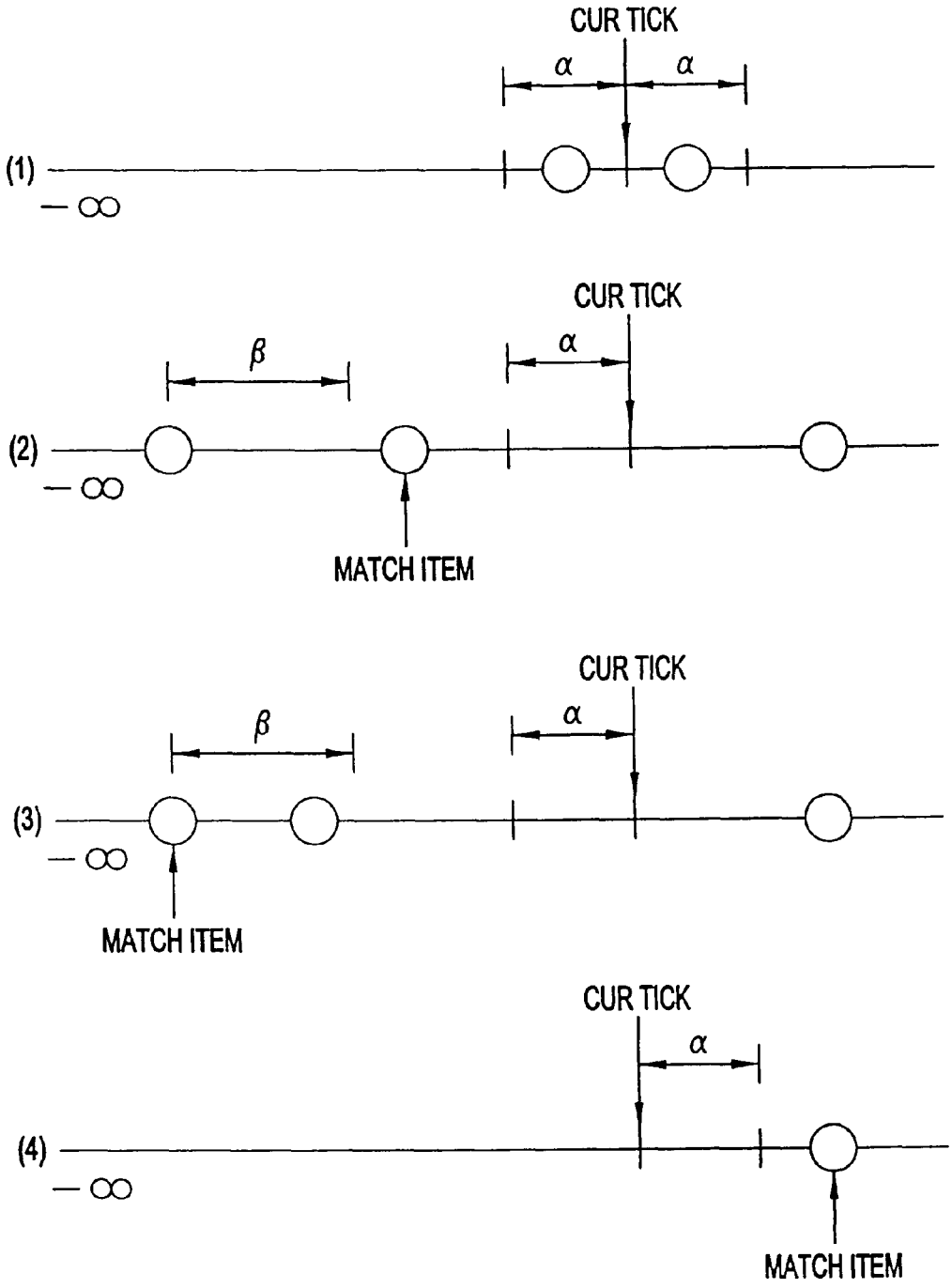
FIG. 1 is a diagram to explain the retrieval rules in a performance position retrieval system for an electronic musical instrument that is one preferred embodiment of the present invention.

An explanation will be given of a concrete example referring to FIG. 1. In FIG. 1, the current position on the music score that is being performed with the automatic performance function is made the current time Cur Tick. This current time Cur Tick is the time that has passed (the time unit is Tick) from the beginning of the composition to the current position of the automatic performance. The item that is designated by the O mark in FIG. 1 indicates the position on the music score of the items (notes) that have been derived from the hash table with the hash keys that have been calculated for the note line that has been performed and input by the performer as an index. The Match Item is the item that is assumed to be the performance position of the performer and to which the automatic performance is made to jump.

As is shown in FIG. 1(1), the items that have been derived from the hash table with the hash keys that have been calculated for the note line that has been performed and input by the performer as an index are ignored in the case where they are within $\pm\alpha$ from the current time Cur Tick (actually, $\alpha$ is the length of one bar), the current time Cur Tick which is the position that is currently being automatically performed with the automatic performance function is taken to be the position of the performance by the performer, and the automatic performance continues to be carried out without jumping. Since it can be considered that the items which are at a position of around ±α with respect to the current time Cur Tick are so because of such things as the fact that the performance timing of the performer is somewhat off, this is done to prevent it being musically unnatural due to the frequent jumping of the automatic performance position.

On the other hand, as is shown in FIG. 1(2) and FIG. 1(3), in the case where the items that have been retrieved from the hash table are temporally the time β or more earlier than the current time Cur Tick, even when there are items that are later in time than the current time Cur Tick, those items are ignored and said items that are earlier in time are made so as to be assumed to be the performance position of the performer. This kind of assumption is made because it is assumed to be a case where the performer is practice performing which is a case where the performer performs repeating a certain phrase, a practice performance returning to a phrase that is earlier than the current performance position can be considered to be customary.

In the case that is shown in FIG. 1(2), even when the items that are earlier in time than the current time Cur Tick are assumed to be the performance position, the items that are closest to the current time Cur Tick (those that are within ±α are excluded as noise) are assumed to be the appropriate items for the performance position of the performer with the condition that other items are not within a time β immediately prior to those items (actually, β is two bars) and the automatic performance position is made to jump to the position of these items. The reason for the assumption of the item that is closest to the current time Cur Tick as the performance position of the performer in this manner is that, in a case where the performer is practice performing repeating a certain phrase, it can be considered that the repeating of a practice and returning to a certain phrase that is not separated that far from the current performance position is something that is natural as an action of the performer.

In addition, in FIG. 1(3), in the case where an item that is prior in time to the current time Cur Tick is assumed to be the performance position, when there are other items that are within a time β (actually, β is two bars) prior to the item that is closest to the current time Cur Tick (those that are within ±α are excluded as noise), the item that is earliest among the items that are mutually within the time β is assumed to be the performance position of the performer, and the automatic performance position is made to jump to the position of that item. The reason for the assumption of the item that is earliest from among the items that are within the time β as the performance position of the performer, is that, in relevant cases, it can be considered that it is a portion of the composition in which the same phrase in the musical composition is repeated a number of times and, in a case where that kind of composition portion is practiced, it can be considered that the performance practice from the very beginning of the repeating phrase is something that is natural as an action of the performer.

In addition, as is shown in FIG. 1(4), in a case where there are items that are later in time than the current time Cur Tick, the item that is closest to the current time Cur Tick (those that are within ±α are excluded as noise) is assumed to be the performance position of the performer.

A explanation will be given of the retrieval processing routine of FIG. 8 in which the above processing is accomplished.

In FIG. 8, the following variables (parameters) are used.

The current time Cur Tick: as discussed previously, this is the current position at which the automatic performance is done by the automatic performance function (the temporal position from the beginning of the composition; the time unit is Tick).

The search time Search Tick: this is the temporal position from the beginning of the composition for the item that has been retrieved from the hash table (called the search item) based on the hash key.

The jump point time Jump Tick: this is the position that is the point that is assumed to be the performance position of the performer and to which the automatic performance is made to jump (the temporal position from the beginning of the composition; the time unit is Tick).

The Search Item: this is the item that is the object of the current retrieval processing that the retrieval processing routine extracts from the hash table.

The Match Item: as discussed previously, this is the item that is assumed to be the performance position of the performer and to which the automatic performance is made to In FIG. 8, when the retrieval processing routine is started, first, "−∞" is assigned as the jump point time Jump Tick (Step S20). Next, a determination is made as to whether the items which, as the results of the retrieval, correspond to the hash keys that have been derived by the computation related to the note line (the four notes) that has most recently been performed by the performer are in the hash table (Step S21). In the case where the items that are search objects (hereafter, referred to as the "Search Item") have been obtained (in a case where this is a multiple number, one is selected in order from the beginning of the hash key fields), a determination is made as to whether the search time Search Tick of the Search Item is earlier than the current time Cur Tick−α (Step S24). If it is within the "current time Cur Tick ±α," it corresponds to the case of FIG. 1(1) and, as will be discussed later, this Search Item is ignored.

In the case where the search time Search Tick is earlier than the current time Cur Tick−α, a further determination is made as to whether the search time Search Tick is earlier or later than the jump point time Jump Tick+β (Step S25). This is a determination of whether it corresponds to either one of the cases of FIG. 1(2) or FIG. 1(3). Even in the case where, at first, one of the items is made the Search Item, since, in Step S20, the above mentioned jump point time Jump Tick is made "−∞," in the determination of Step 25, it is necessary that the search time Search Tick≧the jump point time Jump Tick+β when the processing routine is executed for the first time. Therefore, in Step S26, the processing is carried out in which the Match Item=the Search Item, and the jump point time Jump Tick=the search time Search Tick.

Following this Step S26, it returns to Step S21 and a determination is again made as to whether the search result (the item) is in the hash table. In the case where other items that correspond to the hash keys are not in the hash table, the Match Item that has been set in Step S26 becomes the jump point for the automatic performance. Based on the verification that the jump point time Jump Tick is not "0" or less (Step 22), processing is carried out to make the automatic performance jump to the Match Item (Step S30), and the retrieval processing routine is broken out of.

On the other hand, in the case where there already is another item that corresponds to a hash key (an item that is at the beginning of the hash key fields) in the hash table, that item is retrieved as the next Search Item; and the previously mentioned processing of Steps S24 and S25 is repeated. In this case, if, for the Search Item, the search time Search Tick≧the jump point time Jump Tick+β, then this Search Item, which is the new search object, corresponds to the previously discussed case of FIG. 1(2) and, in this case, since, in the next following Step S26, the Match Item, to which the new search item Search Item has been set, is decided on as the jump point for the automatic performance, it follows through Steps S21, S22 and S30 and this routine is broken out of.

If, with Step S25, for the Search Item, the search time Search Tick<the jump point time Jump Tick+β, then this Search Item, which is the new search object, corresponds to the previously discussed case of FIG. 1(3) and, in this case, this new Search Item is ignored. Then, another search is made to see whether there are no other items in the hash table (Step S21). By repeating this, the processing of FIG. 1(3) is accomplished.

In other words, with the processing of Steps S26 and S27, in the case where there is a Search Item that is more within β than the match item Match Item that is the current jump point when an item is retrieved from the corresponding hash key field in order from the beginning of the musical composition as the Search Item, that Search Item is ignored and the current Match Item (that is to say, the item from among the items that are mutually within β which is nearest the beginning of the musical composition) is made the jump point item as it is. In a case where β is exceeded, since the new Search Item is an item that is closer than the current time Cur Tick, it proceeds to Step S27 and that search item is made the new Match Item of the jump point.

On the other hand, if, for the search time Search Tick of the Search Item, the search time Search Tick>the current time Cur Tick−α, then, a determination is again made as to whether or not the search time Search Tick≦the current time Cur Tick+α, in other words, whether or not there is a Search Item that is within the current time Cur Tick±α (Step S27). If there is a Search Item that is within the current time Cur Tick±α, this corresponds to the case of FIG. 1(1) and, therefore, the Search Item is ignored and the retrieval processing routine is broken out of.

Since, if the search time Search Tick is later in time than the current time Cur Tick+α, this corresponds to the case of FIG. 1(4), in this case, based on the verification that the jump point time Jump Tick is not "0" or less (Step S28), the Search Item is set as the Match Item (Step S29), and, when the automatic performance position is made to jump to the Match Item (Step S30), the retrieval processing routine is broken out of.

Various variations and modes are possible for the preferred embodiments of the present invention. For example, in the preferred embodiment discussed above, the four musical tones that have been most recently input are made the musical tone line (the note line) which is the object of the hash computation. However, the present invention is not limited to this and, as long as the number of musical tones that are the object of the computation is a multiple number it is sufficient. In addition, the sequence of musical tones that are the object of the computation does not necessarily have to be a continuous one and, for example, for the sequence of four musical tones, every other one may be extracted from musical tones that are continuous and made into a musical tone line as the object of the computation. In addition, as the variable that is the object of the hash computation, the pitch of each note is used in the preferred embodiment discussed above. However, the present invention is not limited to this and, for example, such things as the tone length or the pitch plus the tone length may be used.

In addition, in the present invention, it has been set up so that all of the musical tones in the musical composition are sorted in the retrieval table by the hash computation of the above mentioned preferred embodiment. However, the present invention is not limited to that configuration, and as long as it is a mathematical computation such that, by means of the implementation of a transform computation with the data of the musical tone line, the transformation results will be different for items in which the musical tone line data are different, it may be employed in the present invention.

In addition, in the preferred embodiment discussed above, it is set up so that the performer uses a keyboard for the input of the performance data for the musical tones. However, the present invention is not limited to that configuration, and it is possible to utilize other kinds of operator means. Furthermore, it is also possible to apply the present invention to a form such as one, for example, where a song by a performer is input with a microphone such as with a karaoke system, the song is changed into musical tone (note) data and a background accompaniment is automatically performed so that it tracks the song.

In addition, in the above illustration, an explanation was given of the case in which the present invention was installed in the electronic musical instrument as an independent product. However, the present invention is not limited to this and it is also possible to have a preferred embodiment of the present invention in a form in which there is a storage medium in which the program to accomplish the present invention is stored together with the program for the accomplishment of the electronic musical instrument function, the programs are installed in a personal computer from this storage medium and the personal computer is made to function as an electronic musical instrument.

As has been explained above, in accordance with the present invention, it is possible to rapidly and more accurately search for the position in a musical composition that the performer etc. is currently performing with an electronic musical instrument.

What is claimed is:

1. A method for determining a location in a musical composition, the method comprising:

providing a musical composition to be performed;

computing a retrieval table for the composition to be performed;

accepting a musical performance of the composition to be performed;

selecting a location, in the accepted musical performance, to be located in the provided musical composition;

computing a key based on the accepted musical performance; and using the key to index into the retrieval table to find the location in the provided musical composition, which corresponds to the selected location within the accepted musical performance.

2. A method as in claim 1 wherein selecting a location in the accepted musical performance to be found comprises selecting the current location being played of the musical performance being accepted.

3. A method as in claim 1 wherein computing a retrieval table for the composition to be performed further comprises:

a) picking an initial note in the composition to be performed;

b) assigning the note an address based on its relative position with respect to other notes in the composition to be performed;

c) computing a key based on the pitch of the note and the pitch of previous notes;

d) placing the address of the note and the time since the beginning of the composition in a table in a position referenced by the computed key; and e) repeating steps a) through d) until substantially all the notes in the composition to be performed are entered into the retrieval table.

4. A method as in claim 3 wherein computing a key based on the pitch of the note and the pitch of previous notes comprises:

assigning a first number to an initial note representative of its pitch;

multiplying the first number of the initial note by a first constant to form a first sum;

assigning numbers to a plurality of notes temporally prior to the note based on their pitch;

multiplying the numbers representing the plurality of notes by a plurality of constants to form a plurality of sums;

adding the plurality of sums to the first sum to form a total;

performing a modulo divide on the total; and using the results of the modulo divide as an index key to place the initial note in the retrieval table.

5. A method as in claim 4 wherein the assigning numbers to a plurality of notes prior the initial note based on their pitch comprises assigning numbers to the immediately previous three notes based on their pitch.

6. A method as in claim 4 wherein the multiplying the numbers representing the plurality of notes by a plurality of constants to form a plurality of sums comprises multiplying three numbers representing the three notes by three constants to form a three sums.

7. A method as in claim 6 wherein the multiplying of three numbers representing the three notes comprises multiplying three numbers representing three notes immediately preceding the initial note.

8. A method as in claim 6 wherein the modulo divide is a modulo 128 divide.

9. A method as in claim 1 wherein the computing of a key based on the selected location within the musical performance comprises selecting the presently performed note; and computing a key based on the pitch of the presently performed note and the pitch of temporally previous notes.

10. A method as in claim 4 wherein the using the results of the modulo divide as an index key to place notes in the retrieval table comprises using the results of the modulo divide as a key to place an address of a note and a time from the beginning of the note in the retrieval table.

11. A method as in claim 9 wherein computing a key based on the pitch of the presently performed note and the pitch of previous notes comprises:

assigning a first number to the presently performed note representative of its pitch;

multiplying the first number of the note by a first constant to form a first sum;

assigning numbers to a plurality of notes prior the note based on their pitch;

multiplying the numbers representing the plurality of notes by a plurality of constants to form a plurality of sums;

adding the plurality of sums to the first sum to form a total;

performing a modulo divide on the total; and using the results of the modulo divide as a key to access notes in the retrieval table.

12. A method as in claim 11 wherein the assigning a first number to the presently performed note and assigning numbers to a plurality of notes prior the note based on their pitch comprises assigning a number to a chord based on the highest pitch note in the chord.

13. A method as in claim 11 wherein the adding of adding the plurality of sums to the first sum to form a total comprises adding according to the equation:

$$\text{total}=\Sigma[N(i-j)\times\alpha(1+j)]$$

wherein i represents the address of the presently performed note and j represents a series of integers beginning with the integer 0.

14. A method as in claim 13 wherein j represents the series integers 0, 1, 2 and 3.

15. A method as in claim 14 wherein $\alpha 1=5$, $\alpha 2=3$, $\alpha 3=2$ and $\alpha 4=7$.

16. A method as in claim 13 wherein performing a modulo divide comprises performing a 128 modulo divide.

17. A method as in claim 2 the method further comprising:

providing an accompaniment to the musical composition to be performed; and using the location in the provided musical composition to synchronize the performance of the accompaniment to the musical performance.

18. A method as in claim 17 wherein using the location in the provided musical composition to synchronize the performance of the accompaniment to the musical performance performing the accompaniment comprises continuing to perform the accompaniment, if the location in the provided musical composition is within an allowed deviation, and restarting the accompaniment at another location when the deviation is larger than the allowed deviation.

19. A method as in claim 18 wherein the allowed deviation is one bar.

20. A method as in claim 18 wherein the deviation is larger than the allowed deviation and the restarting of the accompaniment is at the first prior position, within the provided musical composition, having a retrieval table entry that matches the provided musical composition.

21. A method as in claim 18 wherein the deviation is larger than the allowed deviation and the first prior position having a retrieval table entry that matches the provided musical composition is within a preset deviation from a second prior position having a retrieval table entry that matches the provided musical composition if both positions are temporally prior to the present location in the provided musical composition then the accompaniment is restarted at the point which is nearer to the beginning of the composition.

22. A method as in claim 21 wherein the preset deviation is two bars.

23. A method as in claim 18 wherein the deviation is larger than the allowed deviation and the first prior position having a retrieval table entry that matches the provided musical composition is within a preset deviation from a second prior position having a retrieval table entry that matches the provided musical composition if both positions are temporally subsequent to the present location in the provided musical composition then the accompaniment is restarted at the point which is nearer to the present location in the provided musical composition.

24. An apparatus for determining a location in a musical composition, the apparatus comprising:

a first memory for data representing a musical composition to be performed;

a second memory for data representing a retrieval table for the composition to be performed;

a device for providing a musical performance of the composition to be performed;

a central processing unit (CPU) containing program code for:

selecting a location, in the accepted musical performance, to be located in the provided composition;

computing a key based on the accepted musical performance; and using the key to index into the retrieval table to find the location in the provided musical composition, which corresponds to the selected location within the accepted musical performance.

25. An apparatus as in claim 24 wherein the device for providing a musical performance of the composition to be performed accepts a live performance by a performer.

26. An apparatus as in claim 24 wherein the device for providing a musical performance of the composition to be performed comprises a keyboard.

27. An apparatus as in claim 24 wherein the device for providing a musical performance of the composition to be performed comprises means for converting an audio input into musical note data.

28. An apparatus as in claim 24 wherein the device for providing a musical performance of the composition to be performed comprises a manual operator.

29. An apparatus as in claim 24 wherein the data representing a retrieval table for the composition to be performed is placed in the second memory by the CPU containing a program code for:

a) picking a note in the composition to be performed;

b) assigning the note an address based on its relative position with respect to other notes in the composition to be performed;

c) computing a key based on the pitch of the note and the pitch of previous notes;

d) placing the address of the note and the time since the beginning of the composition in a table in a position referenced by the computed key; and e) repeating steps a through d for substantially all the notes in the composition to be performed.

30. An apparatus as in claim 24 wherein the first memory is a Read Only Memory (ROM).

31. An apparatus as in claim 24 further comprising:

a third memory for containing an accompaniment to the composition to be performed;

a sound source for performing the accompaniment; and a speaker coupled to the sound source for receiving the performance of the accompaniment and producing sounds comprising the accompaniment.

* * * * *